US009624031B2

(12) United States Patent
Van Bekkum

(10) Patent No.: US 9,624,031 B2
(45) Date of Patent: Apr. 18, 2017

(54) BULK STORAGE TANK MONITORING INCLUDING EVAPORATIVE LOSS ASSESSMENT

(75) Inventor: Frank Van Bekkum, Norcross, GA (US)

(73) Assignee: Honeywell-Enraf B.V., AV Delft (NL)

( * ) Notice: Subject to any disclaimer, the term of this patent is extended or adjusted under 35 U.S.C. 154(b) by 679 days.

(21) Appl. No.: 13/567,638

(22) Filed: Aug. 6, 2012

(65) Prior Publication Data

US 2014/0039816 A1 Feb. 6, 2014

(51) Int. Cl.
*B65D 90/48* (2006.01)

(52) U.S. Cl.
CPC ..... *B65D 90/48* (2013.01); *B65D 2590/0083* (2013.01)

(58) Field of Classification Search
CPC G06F 19/00; G01L 7/00; B65D 90/48; B65D 2590/0083
USPC ..... 702/55
See application file for complete search history.

(56) References Cited

U.S. PATENT DOCUMENTS

| | | | | |
|---|---|---|---|---|
| 4,852,054 | A * | 7/1989 | Mastandrea | 702/51 |
| 5,829,621 | A * | 11/1998 | Laverman et al. | 220/217 |
| 6,527,002 | B1 * | 3/2003 | Szakaly | B64D 37/06 137/14 |
| 8,060,335 | B2 | 11/2011 | Tiberi | |
| 2007/0240494 | A1 * | 10/2007 | Tiberi | 73/49 |

FOREIGN PATENT DOCUMENTS

| | | |
|---|---|---|
| WO | 8804031 | 6/1988 |

OTHER PUBLICATIONS

Wongwises, et al., "An Evaluation of Evaporative Emissions of Gasoline from Storage Sites and Service Stations," Thammasat Int. J. Sc. Tech., Vo .2, No. 2, Jul. (1997).*

Invensys Operations Management, White Paper, "Reducing the Cost of Tank Farm and Terminal Operations Safety Compliance while Increasing Business Value", 2010.*

"Emission Factor Documentation for AP-42, Section 7.1, Organic Liquid Storage Tanks Final Report", for U.S. Environmental Protection Agency, Sep. 2006.*

S. Wongwises et al., "An Evaluation of Evaporative Emissions of Gasoline from Storage Sites and Service Stations", Thammasat Int. J. Sc. Tech., vol. 2, No. 2, Jul. 1997, pp. 1-17.

* cited by examiner

*Primary Examiner* — Mohamed Charioui
*Assistant Examiner* — Catherine Rastovski
(74) *Attorney, Agent, or Firm* — Jetter & Associates, P.A.

(57) ABSTRACT

A method of storage tank monitoring including calculating liquid inventory within the storage tank. Real-time parameters associated with evaporative loss of a liquid stored within the storage tank are determined to produce input data. The real-time parameters include at least one condition within the storage tank and at least one environmental condition. Evaporative loss is automatically calculated with an inventory calculation algorithm using the input data and at least one known physical property of the liquid in the storage tank.

13 Claims, 6 Drawing Sheets

BULK STORAGE TANK MONITORING INCLUDING EVAPORATIVE LOSS ASSESSMENT

FIELD

Disclosed embodiments relate to real-time evaporative loss assessment for bulk storage tanks.

BACKGROUND

Bulk storage tanks, particularly those that are vented to the atmosphere, tend to lose significant amounts of volatile fluid contents due to evaporative losses. Such losses, if ignored, can have an undesirable effect on the accuracy of stock reconciliation. Moreover, various countries, including the United States and Australia, levy penalties based on evaporative losses. Evaporative loss assessment is currently only calculated periodically (typically once a year for permitting purpose) using earlier obtained estimates and calculation procedures as described in standards such as EPA AP 42 and API CELE Chapter 19, for example. Improved tank monitoring including more accurate and more timely evaporative loss assessment is needed to realize improved operations (i.e., operational excellence), lower cost and losses, and for increasing awareness and reducing environmental emissions.

SUMMARY

This Summary is provided to introduce a brief selection of disclosed concepts in a simplified form that are further described below in the Detailed Description including the drawings provided. This Summary is not intended to limit the claimed subject matter's scope.

Disclosed embodiments include methods of calculating evaporative losses for a liquid stored within a storage tank, which involves determining real-time parameters associated with evaporative loss of a liquid stored within the storage tank to produce input data. The real-time parameters include at least one condition within the storage tank and at least one environmental condition. Evaporative loss, comprising at least one of static evaporative loss and dynamic evaporative loss, is automatically calculated with a disclosed inventory calculation algorithm using the input data and at least one known characteristic of the liquid in the storage tank.

Disclosed embodiments also include systems for calculating evaporative losses for a liquid stored within a storage tank, which includes a plurality of sensors for determining real-time parameters associated with evaporative loss of a liquid stored within the storage tank to produce input data. The real-time parameters include at least one condition within the storage tank and at least one environmental condition. A computing device having associated memory stores the inventory calculation algorithm, where the computing device is programmed to implement an inventory calculation algorithm. The inventory calculation algorithm automatically calculates static evaporative loss and/or dynamic evaporative loss using the input data and at least one known characteristic of the liquid in the storage tank.

DETAILED DESCRIPTION

Figure 1:
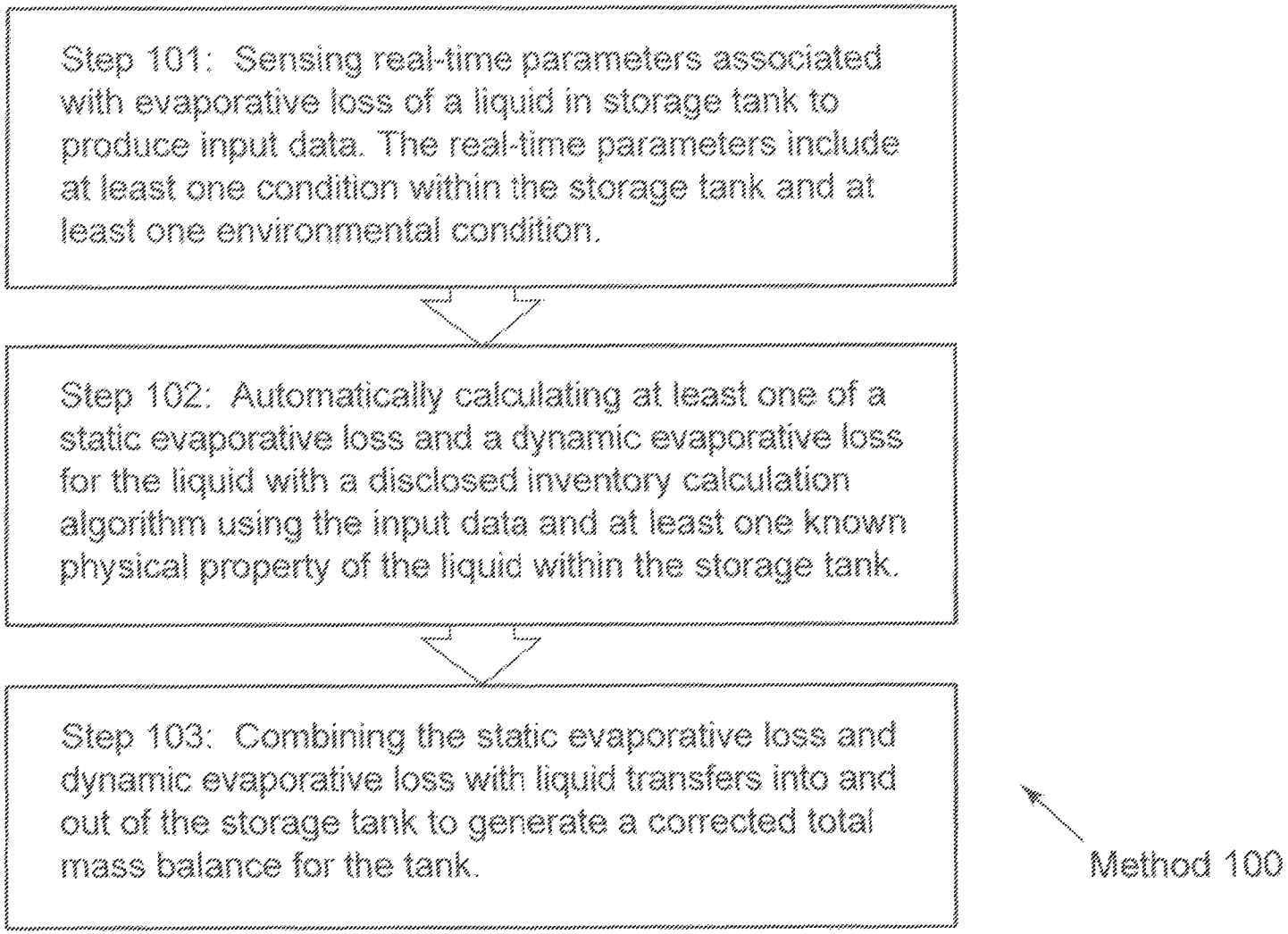
FIG. 1 is a flowchart that shows steps in an example method of monitoring and calculating evaporative losses for a liquid stored within a storage tank, according to an example embodiment.

Disclosed embodiments are described with reference to the attached figures, wherein like reference numerals are used throughout the figures to designate similar or equivalent elements. The figures are not drawn to scale and they are provided merely to illustrate certain disclosed aspects. Several disclosed aspects are described below with reference to example applications for illustration. It should be understood that numerous specific details, relationships, and methods are set forth to provide a full understanding of the disclosed embodiments. One having ordinary skill in the relevant art, however, will readily recognize that the subject matter disclosed herein can be practiced without one or more of the specific details or with other methods. In other instances, well-known structures or operations are not shown in detail to avoid obscuring certain aspects. This Disclosure is not limited by the illustrated ordering of acts or events, as some acts may occur in different orders and/or concurrently with other acts or events. Furthermore, not all illustrated acts or events are required to implement a methodology in accordance with the embodiments disclosed herein.

Disclosed embodiments provide bulk storage tank monitoring including evaporative loss assessment in real-time, and based on actual tank conditions, while maintaining general compliance with industry standards, such as the American Petroleum Institute Manual of Petroleum Measurement Standards (API MPMS) Ch. 19, 1$^{st}$ Edition, published July, 1998, reaffirmed: October, 2007; much of this work is based on research done by the EPA, published under EPA AP 42, Volume I, 5th edition, published January 1995.

Pertinent loss-related parameters associated with conditions involving the storage tank are dynamically measured by proximately positioned sensors that can be mounted on the outside, inside, and/or in the vicinity of the tank; and input data points are automatically taken therefrom by a computer-based system that using a disclosed inventory calculation algorithm which calculates real-time evaporative loss based on the input data points. As the conditions vary, the calculations change, and thus the cumulative evaporative loss can be accurately determined. The precision of disclosed methods is generally only limited by the sensitivity and accuracy of the sensors, and the precision and accuracy of the model used (for example, how complex, how many redundant sensors).

FIG. 1 is a flowchart that shows steps in an example method 100 of storage tank monitoring including calculating evaporative losses for a liquid stored within the storage tank, according to an example embodiment. Typical storage tanks being monitored by disclosed embodiments comprise a metal which have a capacity to store at least hundreds of gallons of the liquid. For example, a 60 ft. tall vertical, cylindrical tank of 80 ft. diameter can contain 54,000 bbls (1 bbls[(1=1 US oil barrel=42 U.S. gallons).

Step 101 comprises determining real-time parameters associated with evaporative loss of the liquid to produce input data. Various sensors proximate to the storage tank provide input data representing real-time parameters associated with evaporative loss of the liquid stored within the storage tank.

Such proximately placed sensors can be placed on the inside of a tank, on the outside of the tank, and/or in the general vicinity of the tank to provide the parameters to enable calculating static and dynamic vapor loss. Sensors on the inside of the tank can measure, for example, liquid level, liquid temperature, vapor space temperature, and vapor space pressure. Sensors on the outside of the tank can measure tank exterior temperature, and can monitor, for example, the opening and closing of the breather vent and/or vacuum release valves. Sensors in the vicinity of the tank can measure, for example, ambient temperature, humidity, solar insolation, wind speed, and wind direction.

Input data can be collected from all or selected sensors and used in the calculations. The sensors collectively determine at least one condition within the storage tank and at least one environmental condition. The condition(s) within the storage tank can comprise, for example, one or more of vent valve position, vapor pressure, vapor temperature, liquid pressure, liquid temperature, and liquid level. The environmental condition(s) can comprise, for example, one or more of wind speed, wind direction, solar insolation, and air temperature. Data from example nearby meteorological stations can be used (for example via the Internet) to capture environmental data (ambient temperature, solar insolation, wind speed, for example), provided the sensor location is sufficiently representable for the site (so-called micro-climates could cause significant errors). Use of such data sources could reduce the system cost.

Input data can also be obtained from meters or other measuring devices that measure the amount and/or transfer rate of liquid transferred into and out of the tank to produce liquid transfer data. Data can be obtained from tank gauging equipment, including, for example, infrared monitoring of tank shell temperatures. Moreover, input data can be obtained from known physical properties of the liquid, such as, for example, product composition (for example from analysis by gas chromatograph), parameters such as density, volatility, and viscosity (both being a function of the particular liquid composition and temperature). Input data can also include properties of vapors and/or gases in the void space of the tank, possibly even that from previous cargoes and/or processes.

Step 102 comprises automatically calculating at least one of a static evaporative loss and a dynamic evaporative loss for the liquid with a disclosed inventory calculation algorithm using the input data and at least one known physical property of the liquid within the storage tank. As noted above, the known physical property of the liquid within the storage tank can be volatility or viscosity of the liquid. The automatically calculating can use an inventory calculation module realized by a computing device programmed to implement a disclosed inventory calculation algorithm.

The inventory calculation algorithm can provide predictive calculations of forecasted static and dynamic evaporative losses based on intended operational activity. Step 103 comprises optionally combining the static evaporative loss and dynamic evaporative loss with liquid transfers (movements) into and out of the storage tank to generate a corrected total mass balance for the storage tank. Liquid movements are typically measured by flow sensors.

The method can also include reporting evaporative losses in terms of integrated, time-averaged loss and real-time loss. The method can also comprise alarming upon sensing a condition within the storage tank or an environmental condition being beyond a predetermined threshold or a predetermined range. The predetermined threshold and/or predetermined range can be user programmable.

Figure 2A:
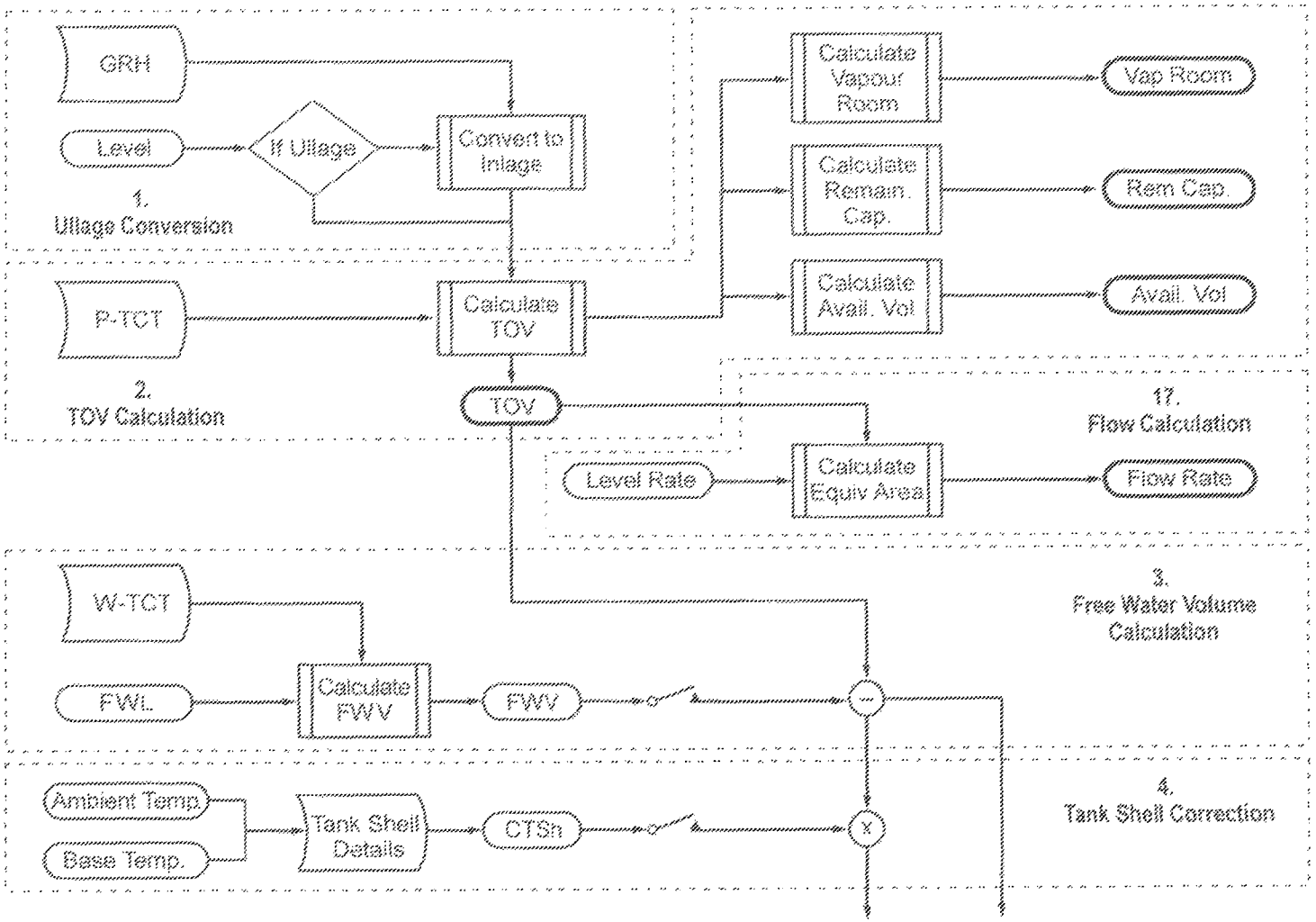
FIGS. 2*a*, 2*b*, 2*c* are contiguous top, middle and bottom segments, respectively, of a flow chart that shows further details in an example method of monitoring and calculating evaporative losses for a liquid stored within a storage tank, according to an example embodiment.
Figure 2B:
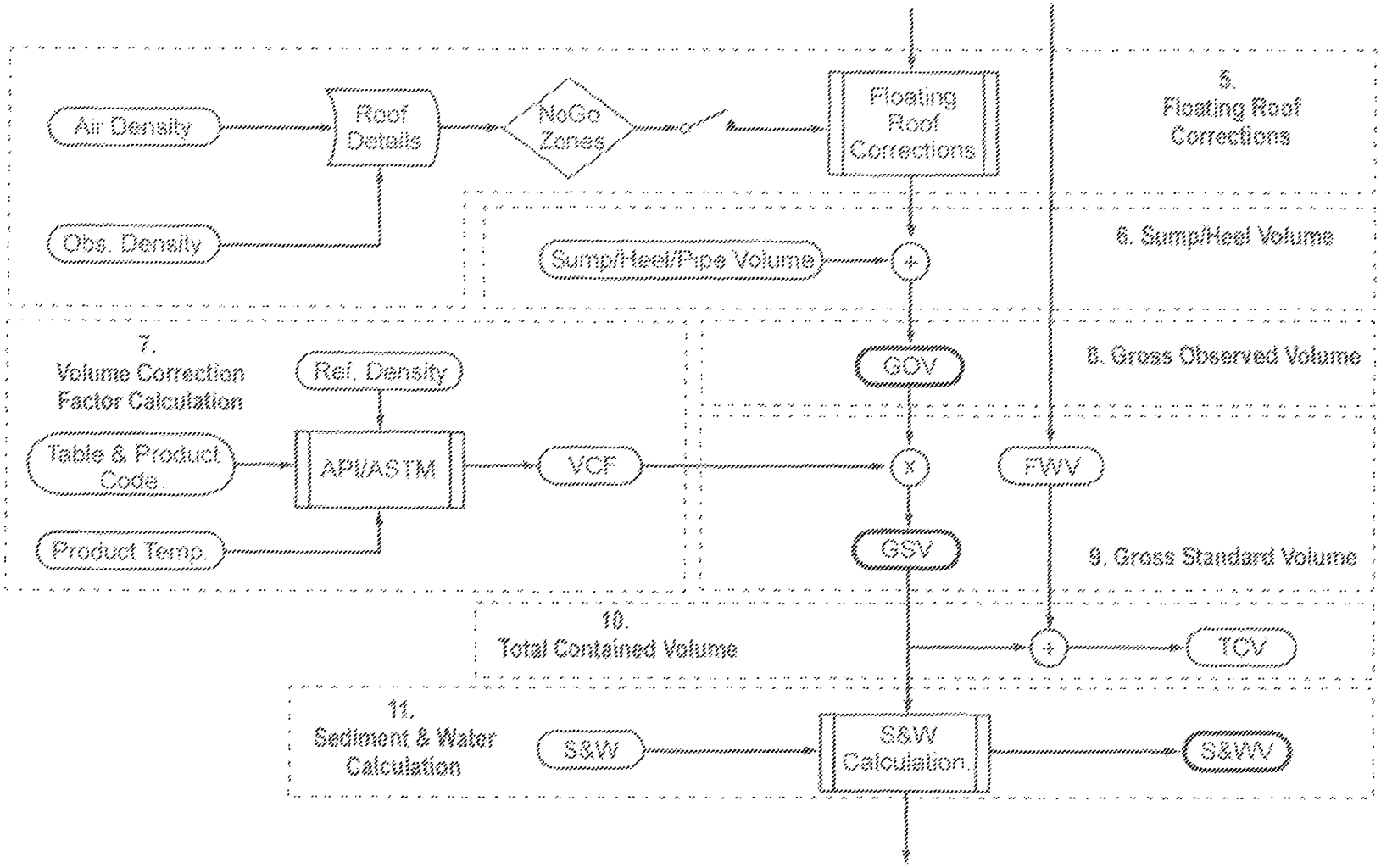
Figure 2C:
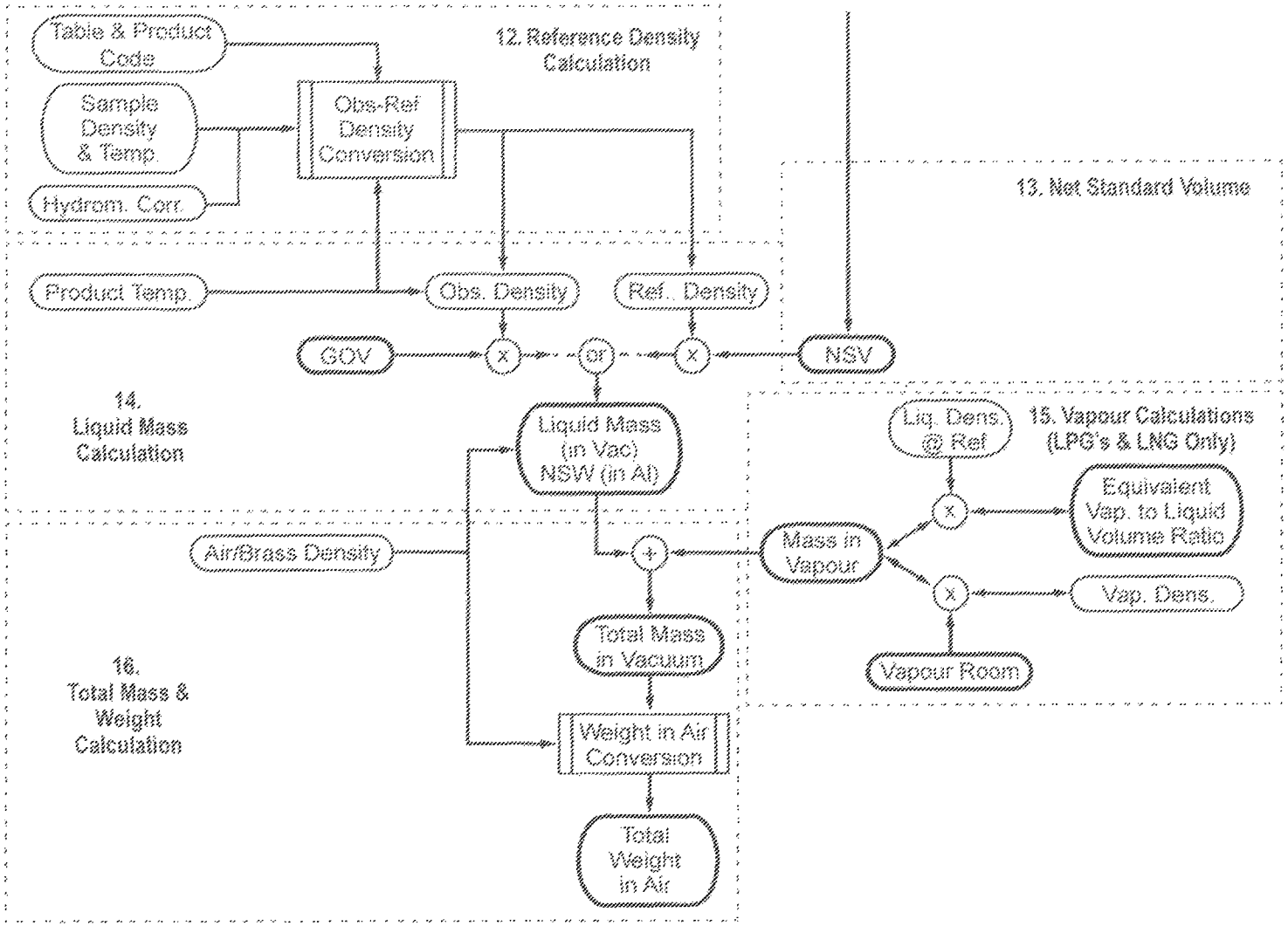

FIGS. 2*a*, 2*b*, and 2*c* are contiguous segments of a flowchart that shows further details of steps in an example method, such as that shown in FIG. 1. Abbreviations and terms used therein are known in the art.

The flowchart shown in FIGS. 2*a*, 2*b*, 2*c* is divided into seventeen dashed boxes. A first box shows the conversion of any ullage data to innage. Level is typically innage measured manually or by a gauge. It is well known that innage=GRH (gauge reference height)−ullage.

A second box includes several further calculations. A Tank Capacity Table (TCT) contains data for converting product height (level) into volume. TCT contains actual measurements of the exact dimensions of a tank, which is generally not a perfect cylinder. TCT generally includes heel volume. P-TCT is for product in a tank. TOV means Total Observed Volume, which can include water, for example. VapRoom means Vapor Room—empty space inside a tank, generally filled with vapor. RemCap means Remaining Capacity—an amount of product that can be safely added to a tank. AvailVol means Available Volume—an amount of product that can be pumped out of the tank at low suction.

A third box shows an optional Free Water Volume (FWV) calculation. FWV is water at the bottom of a tank which has separated and is measured as Free Water Level (FWL). The presence of water is usually undesirable. Water is often confined in a sump, and can be measured manually or by certain a servo or capacitive gauge. W-TCT is a TCT for a tank equipped with a water sump. Water can be measured in reference to the water sump instead of a tank zero or datum plate. A disconnect switch in the flowchart means that a calculation step is optional and can be selectively disabled.

A fourth box shows an optional Correction of Tank Shell (CTSh) for temperature in order to calculate volume of a tank back to a standard volume. Ambient temperature and a base temperature are factors as well as tank shell details. A tank shell generally expands and contracts with temperature changes and corrections must be made compared to TCT calibration temperature. For heated products the CTSh can be in excess of 0.3% TOV. Tank shell temperature can also effect gauge and manual readings.

A fifth box shows an optional Floating Roof Correction (FRC) calculation where air density and observed density are factors as well as floating roof details. A floating roof reduces the evaporative losses of lighter fractions of a product. A floating roof can weigh in excess of 500,000 kg, displacing liquid, necessitating correction for weight of floating roof. Floating roof correction can be already at least partially accounted for in the TCT. In such cases only a correction for the actual observed density is applied.

A sixth box shows sump/heel volume calculation that can be added to the TOV or utilized separately. A seventh box shows a volumetric temperature correction calculation to determine Volume Correction Factor (VCF). VCF can be important because hydrocarbons have high thermal expansion coefficient (close to 0.1% per ° C.). For example, a tank having a height of 15 m and a diameter of 36 m has an equivalent surface area of 1,000 $m^3$ and a total tank volume of 15,000 $m^3$. A temperature uncertainty of 0.25° C. translates into a volumetric uncertainty of 3.8 $m^3$. The use of VCF tables is often not recommended due to the lack of precision and accuracy, which can lead to the introduction of errors into the calculation. Actual product temperature is measured and applied to a reference density (Ref. density) (calculated in box 12) and an API/ASTM Table & Product Code. API/ASTM tables, generally considered to be a primary need for any tank inventory system, are based on a globally accepted industry standard used by nearly all major oil companies.

An eighth box shows Gross Observed Volume (GOV), which can be calculated from TOV by subtracting FVW, applying CTSh, FRC, and adding sump/heel volume, as desired. A ninth box shows Gross Standard Volume (GSV)—volume at reference temperature that is expressed as GOV X VCF. GSV is typically 15° C. in Europe and 60° F. in the U.S., although 20° F. and 30° F. are used in some countries. It is also possible to us a well-known calculation to determine a so called "alternative reference temperature", which can be useful to compare volumes at other temperatures. FWV may optionally be considered separately as shown.

A tenth box shows that GSV can be combined with FWV to produce Total Combined Volume (TCV). An eleventh box shows a sediment & water (S&W) calculation which determines sediment & water Volume (S&WV). It is well-known that some products have entrained (suspended) sediment and/or water. S&W is generally determined from sample by laboratory method ('Karl-Fisher' technique), usually along with other typical quality parameters, such as, for example wax-point (diesel), octane number (gasoline), sulfur content, pour point, cetane number, TOX, $NO_x$, VOCs and/or $SO_x$.

A twelfth box shows a reference density calculation. Reference density, needed for calculating VCF (seventh box, described hereinabove), is generally calculated from sampled data. Hydrometer correction is generally necessary when density is measured with a glass hydrometer. Once the reference density is known also the observed density under actual tank conditions can be calculated, which is needed for calculating FRC (fifth box, described hereinabove).

A thirteenth box shows Net Standard Volume (NSV), which is corrected for suspended sediment and water (S&W) in a product. NSV is temperature and S&W corrected and is internationally used for custody transfer under certain protocols. A fourteenth box shows a liquid mass calculation. Mass is temperature and product property independent, and is needed for loss reconciliation. Mass can be calculated in two ways: (1) from NSV and the reference density and/or (2) from GOV and observed density). Any difference between (1) and (2) is generally due to uncertainty of assessment of observed density vs. temperature. Liquid mass can be expressed in terms of mass in vacuum or weight in air (NSW).

A fifteenth box shows vapor calculations applicable to pressurized applications such as, for example, liquid petroleum gas (LPG) and liquid nitrogen gas (LNG). In order to correct for "liquid in vapor", gas calculations are normally based on gas composition, including fractions of individual components, such ethane, methane, propane, nitrogen, for example.

A sixteenth box shows total mass and weight calculations. Total mass is equal to the sum of liquid mass and mass in vapor, which is useful for loss control (reconciliation).

A seventeenth box shows a flow rate calculation, which can be an important safety feature. Level rate is generally derived from level changes, and is used to verify that the full amount of product is flowing into an intended tank.

Automatic calculations can perform density and temperature corrections, for example, using the standards API MPMS Chapter 11.1-2004/Adjunct toIP200/04/Adjunct to ASTM D1250-04 (ADJD1250CD), and can accurately calculate delivered volumes at standard conditions (60° F., 15° C., 20° C., and/or at user-selectable temperature) using double precision math. Moreover, temperature volume correction factor is calculated, for example, in accordance with the following standards:

API MPMS Chapter 11.1 (1980)/API2540 (1980)/ASTM D1250/ANSI D1250/IP200: Tables 5A, 5B, 5D, 6A, 6B, 6C, 6D, 23A, 23B, 23D, 24A, 24B, 24C, 24D, 53A, 53B, 53D, 54A, 54B, 54C, 54D.

API MPMS 11.1 (2004)/ASTM D1250-04/IP200/04

ISO 91.1 (1992)

ISO 91.2 (1991)/IP3 (1988): Tables 59A, 59B, 59D, 60A, 60B, 60D.

GPA TP27 (2007) (supersedes TP-25)/API MPMS Chapter 11.2.4: Tables 23E, 24E, 53E, 54E, 59E, 60E.

Disclosed embodiments thus can provide measurements for both static and dynamic evaporative losses. Static losses occur when no liquid is being added to a storage tank or removed therefrom, due to environmental changes, such as due to the ambient temperature, humidity, wind speed and direction, and the amount of direct sunlight that impinges on the tank. Moreover, a full tank contains mostly liquid and a small amount of vapor, while a nearly empty tank contains a little liquid and a large amount of vapor. Therefore the potential for vapor loss is indirectly proportional to the liquid level in the tank, particularly with a fixed roof tank (e.g., see the tank 50 in FIG. 3).

Dynamic losses occur when liquid is being transferred into or out of a tank. In the case of a fixed-roof tank, vapors are vented when liquid is added to the tank, and lost. Moreover, when fluid is removed from the tank, fresh air is drawn into the tank, which becomes saturated with vapors. In the case of a floating roof tank (see tank 82 in FIG. 4), the salient loss vector occurs when fluid is removed from the tank. As the floating roof drops, the wetted interior tank shell is exposed, and the liquid evaporates into the atmosphere. Loss can increase significantly when the roof is landed.

Figure 3:
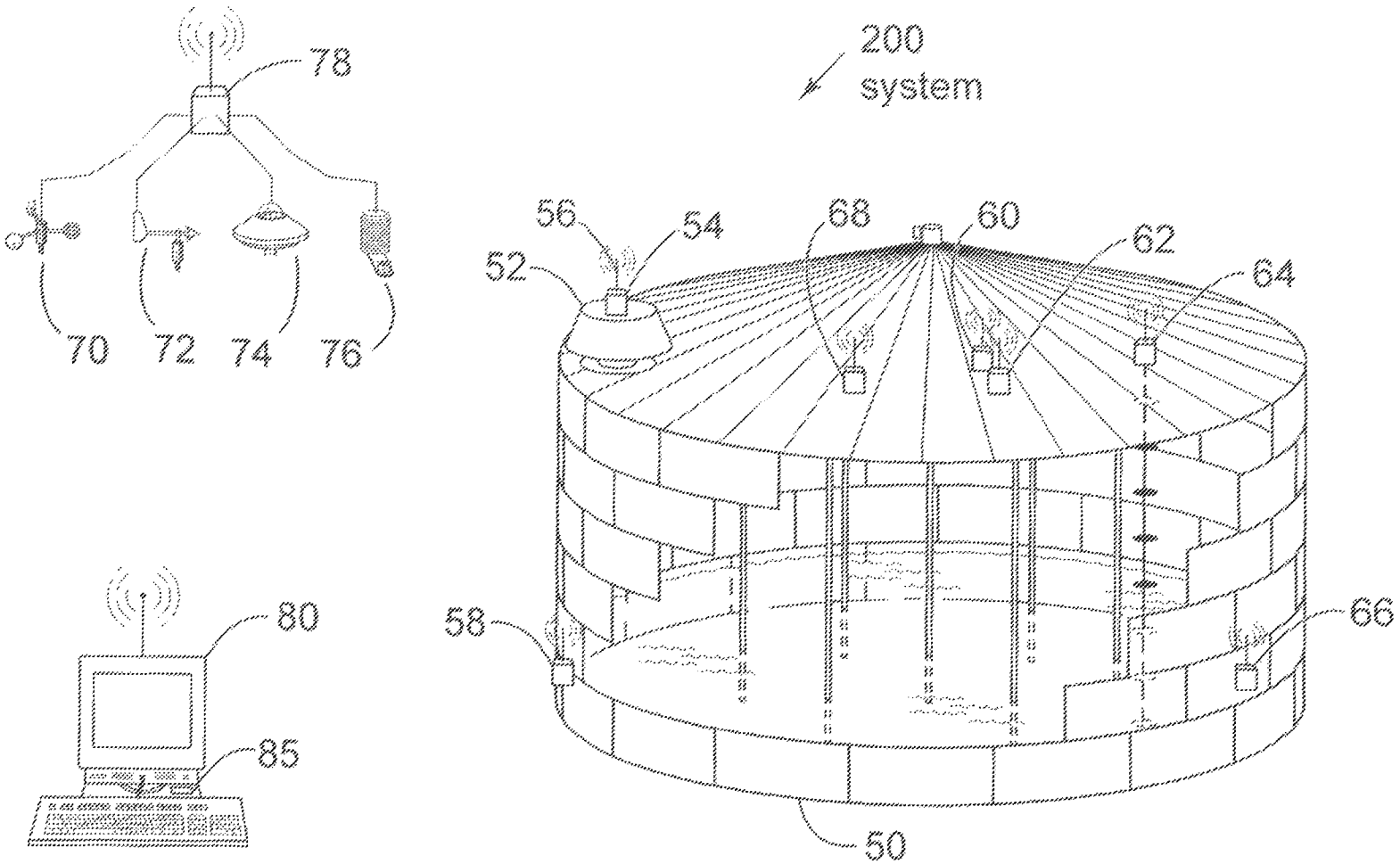
FIG. 3 shows an example system for monitoring and calculating evaporative losses for a liquid stored within a fixed or so-called "cone" roof storage tank, according to an example embodiment.

FIG. 3 shows an example system 200 for monitoring and calculating evaporative losses for a liquid stored within a storage tank, according to an example embodiment. Although the storage tank 50 is shown as an above ground tank, disclosed embodiments also provide monitoring for underground and partially underground storage tanks, etc. Moreover, disclosed embodiments are effective for virtually any size or type of storage tanks. For example, although the tank 50 is shown having a generally cylindrical shape, the particular size, shape and type of tank are not a limitation to disclosed embodiments.

System 200 monitors a vented tank 50 and includes related proximately placed sensors (58, 60, 62, 64, 66, 68, 70, 72, 74 and 76). A pressure vent and/or vacuum release valve 52 is equipped with a sensor or switch 54 to detect the position of the valve 52. Such functions can be combined, depending on the application and installation. Examples of other sensors that can be mounted in and/or on the tank 50 shown in FIG. 3 include a pressure sensor 58 for measuring measure product density, a vapor temperature sensor 60, a vapor pressure sensor 62, an average product temperature sensor array 64 and/or a spot (single location) temperature sensor 66, and a product level sensor 68.

Environmental sensors on or in the vicinity of the tank 50 can include wind speed sensor 70, wind direction sensor 72, solar insolation sensor 74, and air temperature sensor 76.

Sensors 70, 72, 74, 76, can be grouped and associated with a common wireless communication device 78. However, wired connections may also be used.

System 200 includes a computing device 80. The computing device 80 has memory 85 that comprises non-transitory machine readable storage (e.g., static RAM) that stores a disclosed inventory calculation algorithm. The computing device 80 is communicably connected to receive input data from the respective sensors (58, 60, 62, 64, 66, 68, 70, 72, 74 and 76). The computing device 80 is programmed to implement the inventory calculation algorithm, including automatically calculating at least one of a static evaporative loss and a dynamic evaporative loss for the liquid using the input data and at least one known physical property of the liquid within the storage tank, such as the liquid's volatility.

Figure 4:
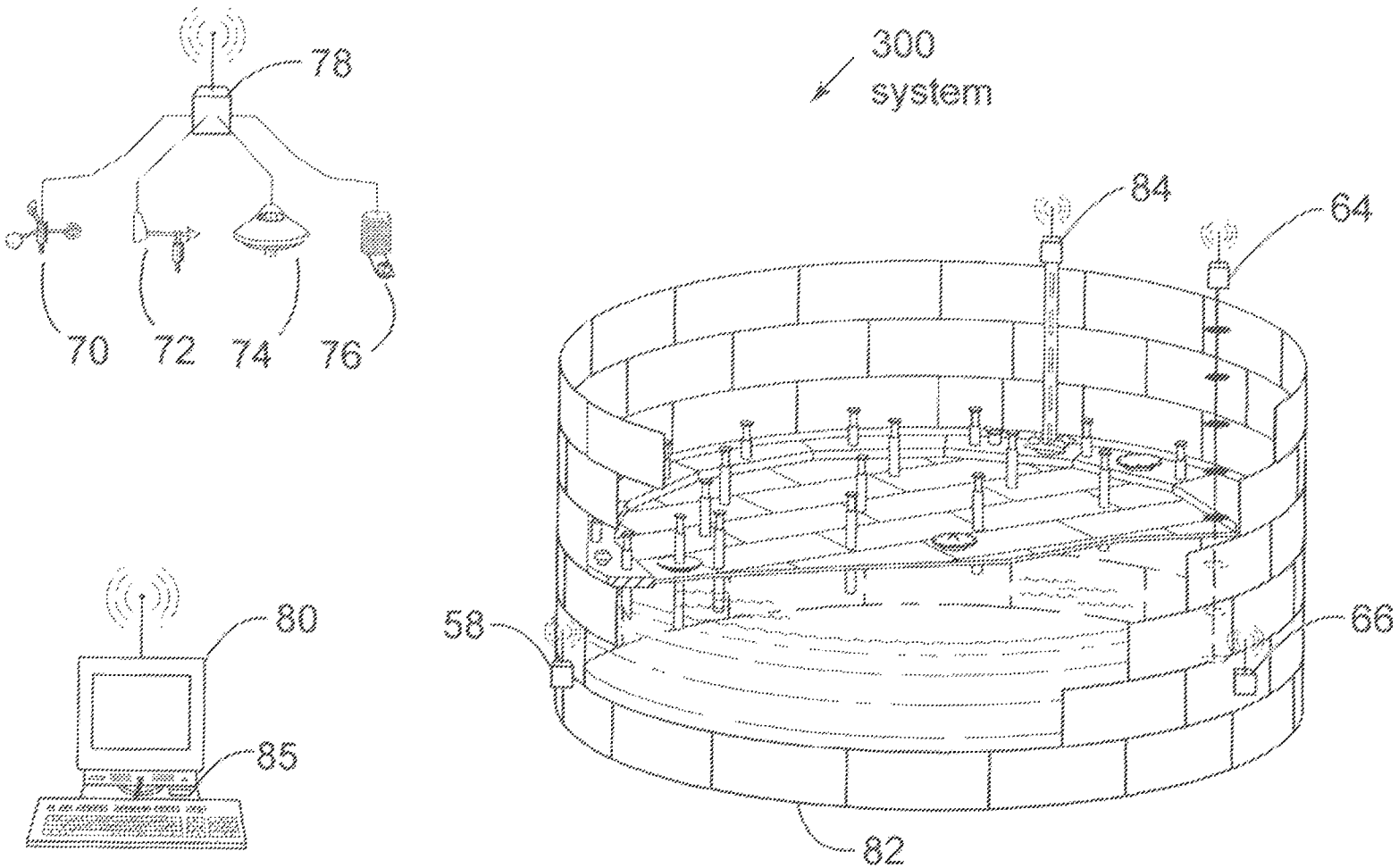
FIG. 4 shows an example system for monitoring and calculating evaporative losses for a liquid stored within a storage tank, where the tank is an external floating roof tank, according to an example embodiment.

FIG. 4 shows an example system 300 for monitoring and calculating evaporative losses for a liquid stored within a storage tank, according to an example embodiment, where the tank is an external floating roof tank 82. Many of the sensors shown in FIG. 3 are shown in FIG. 4, identified with like numerals, but there can be some differences. For example, a product level sensor 84 can be of a different configuration.

The skilled artisan will recognize that each of the foregoing sensors can be hardwired or wireless-capable (including for example, an antenna 56) in order to communicate with a computing device 80 to transmit input data and/or receive instructive signals. Moreover various sensors can be grouped in order to communicate via a common wired or wireless communication device.

Disclosed embodiments enable improved management of tank evaporative losses, in terms of both strategies and tactics. The inventory calculation algorithm can report evaporative losses in terms of averaged loss and real-time loss, combine evaporative loss with liquid transfers into and out of said storage tank to generate a corrected total mass balance for the tank, and alarm upon detecting conditions which could result in excessive evaporative losses based on predetermined thresholds. Such thresholds can be programmable and/or set according to customer needs, government regulations, or other guiding principles. Disclosed embodiments can provide predictive calculations on forecasted losses based on intended operational activity such as, for example, roof landing, tank movement as function of time, and the like.

Stock reconciliation is an important tool for management of tanks, where the mass balance is continuously assessed in combination with the measurement uncertainties. The resulting output data is monitored, often using statistical methods, to detect trends and deviations. Accurate, precise stock reconciliation methods can be used to assess evaporative losses as well as to detect problems such as, for example, in flow meters, tank gauges, tanks, and other issues such as loss of accuracy, or in the worst case, leaks. The quality of stock reconciliation can be significantly improved by reducing the uncertainties in the mass balance. Disclosed embodiments provide significant improvements in stock reconciliation that have a beneficial effect on human and environmental safety, as well as saving valuable product.

One example of how to improve stock reconciliation is the inclusion of vapor emissions calculations in inventory and transfer calculations to improve the total stock assessment. Both mass and equivalent volume is generally estimated for liquid stock and evaporative losses. Vapor emissions calculations can be derived from input data obtained from sensors placed in, on, and in the vicinity of a tank.

Vapor emissions calculations for static losses can be calculated from (1) periodic emissions, such as hourly, daily, and/or other time period, and/or (2) event-based emissions such as opening or closing vents and vacuum release valves. Calculated vapor emissions calculations can be combined with receipts and deliveries to correct the total mass balance. Calculations can include instantaneous values and totalized values. Input data for the calculations include product composition, temperature and pressure of vapor space in tank, ambient conditions, tank condition, and tank configuration such as specific tank hardware, including roof legs, for example.

Vapor emissions calculations for dynamic losses can be calculated from periodic emissions, such as hourly and daily emissions, based on exposed wet tank shell, actual wind speed, ambient temperature, movement of the roof, possibly roof landing, and the like.

Further refinements to the method can include calculations of assessment losses from tank appendages, such as floating roof rim seal, roof seal malfunctions, roof legs, and the like, all of which can conform to industry standards such as API MPMS Ch. 19.

Output emission data provided by disclosed embodiments can be based on actual conditions and operations, rather than averages and generalizations used in generally accepted industry practice. For example, the disclosed methods can automatically measure and make calculations based on actual liquid transfers, and not simply rely on total throughput in order to assess dynamic losses. Moreover, disclosed methods can automatically measure and make calculations based on actual, real-time meteorological conditions and tank temperatures, and not simply on geographical and weather averages in order to assess the dynamic losses. Moreover, disclosed methods can automatically measure and make calculations based on actual paint color and conditions and solar irradiation of the tank shell, and not rely on generalized parameters such as simply being either "white" or "gray". Calculations can be made in accordance with API MPMS Ch. 19, or the like.

Reconciling various losses into the total mass balance in accordance with disclosed methods results in a significant reduction in the uncertainty of the stock reconciliation. Thus, the quality of the trend monitoring is significantly improved such that the output data is useful for early detection of equipment which is leaking, malfunctioning, and/or running "out of specification". Even procedural errors and other anomalies can be detected. For example, a malfunctioning flow meter, tank gauge issues, errors in measurement procedures, and tank capacity tables can be detected at an earlier stage than with generally accepted industry practice.

Output data sets and trends derived from calculations of hourly and daily losses enable optimization of operational procedures in order to mitigate losses. For example, improved output data can show actual reduction in losses achieved by filling a tank early in the morning rather than filling the tank in the late afternoon. Moreover, such output data can show actual reduction in diurnal losses achieved by keeping a tank full at the end of a day. The skilled artisan can thus see that an advantage of disclosed embodiments is that, as losses become visible and known, those losses become manageable. Disclosed embodiments can improve operation and cost efficiency by lowering uncertainty in stock reconciliation. Moreover, disclosed embodiments can continue to aid in reducing emissions over time as feedback with dynamic input and output data is accumulated.

Disclosed embodiments can be applied generally to liquids in the oil, gas, petrochemical, and solvents handling and storage industries, for example. Moreover, disclosed embodiments can be applied to bio-products, and waste handling and storage. For example, such materials often generate methane, which is considered a volatile emission.

Disclosed embodiments are further illustrated by the following specific Examples, which should not be construed as limiting the scope or content of this Disclosure in any way. While various disclosed embodiments have been described above, it should be understood that they have been presented by way of example only, and not limitation. Numerous changes to the subject matter disclosed herein can be made in accordance with this Disclosure without departing from the spirit or scope of this Disclosure. In addition, while a particular feature may have been disclosed with respect to only one of several implementations, such feature may be combined with one or more other features of the other implementations as may be desired and advantageous for any given or particular application.

EXAMPLES

Disclosed embodiments are further illustrated by the following specific Examples, which should not be construed as limiting the scope or content of this Disclosure in any way.

An example of static loss assessment is provided. It was assumed the storage tank is 25 m diameter and 15 m high. The volume was then ~7400 $m^3$. It was also assumed the tank was partially filled (2.5 m). The void volume is then ~6000 $m^3$. A diurnal temperature change of 20° C. was assumed. It was further assumed the tank was open (i.e. no breather valve). Then the approximate breathing volume change was 7% or 430 $m^3$. A typical vapor density of gasoline is 5-6 $kg/m^3$ (liquid density ~700 $kg/m^3$).

Hence the lost mass was ~1900 kg per day cycle, which equals ~0.05% of the liquid inventory @ 2.5 m. The typical uncertainty of tank volume is 0.1%-0.25% (depending on the tank's capacity table (TCT) calibration). After 10 days the additional uncertainty is twice the size of the tank volume uncertainty in the mass balance.

An example of Dynamic Loss assessment is now provided. The same tank as above is assumed. i.e. a tank of 25 m diameter and 15 m high. The tank volume was then ~7400 $m^3$. It was also assumed the tank was partially filled (2.5 m). The void volume was then ~6000 $m^3$. It was also assumed the tank was filled up to max level, i.e. 15 m (=6132 $m^3$ or 4.300 metric ton). This means a volume of 6000 $m^3$ was displaced and expelled into the atmosphere.

Assuming the same densities, i.e. 27000 kg's was expelled. This equals ~0.6% of the liquid mass. As a result, the mass balance is 0.6% off (too low).

The mass balance says Mass at Opening (Start) plus or minus Transferred Mass equals the mass at closing (end). As the transferred mass is only the measured liquid (measured by flow meter for example) the evaporative losses are not in the equation. Hence while V $m^3$ of product is transferred −1 $m^3$ is approximately expelled. Assuming the densities are LD for the liquid and GD for the gas, then V×LD is transferred (mass) and V×GD is lost, not measured and hence causing an unbalance of GD/LD % or uncertainty.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising."

As will be appreciated by one skilled in the art, the subject matter disclosed herein may be embodied as a system, method or computer program product. Accordingly, this Disclosure can take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, this Disclosure may take the form of a computer program product embodied in any tangible medium of expression having computer usable program code embodied in the medium.

Any combination of one or more computer usable or computer readable medium(s) may be utilized. The computer-usable or computer-readable medium may be, for example, but not limited to, an electronic, magnetic, optical, electromagnetic, infrared, or semiconductor system, apparatus, or device. More specific examples (a non-exhaustive list) of the computer-readable medium would include non-transitory media including the following: an electrical connection having one or more wires, a portable computer diskette, a hard disk, a random access memory (RAM), a read-only memory (ROM), an erasable programmable read-only memory (EPROM or Flash memory), a portable compact disc read-only memory (CDROM), an optical storage device, or a magnetic storage device.

Computer program code for carrying out operations of the disclosure may be written in any combination of one or more programming languages, including an object-oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer, server, embedded platform, and/or in the form of cloud computing such as executing the calculations as a web service. Such a system and/or computer may be connected to the user's computer through any type of network, including a local area network (LAN) or a wide area network (WAN), or the connection may be made to an external computer (for example, through the Internet using an Internet Service Provider).

The Disclosure is described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a physical computer-readable storage medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide processes for implementing the functions/acts specified in the flowchart and/or block diagram block or blocks.

I claim:

1. A system for monitoring a hydrocarbon liquid mixture stored within a storage tank, comprising:

a plurality of sensors installed on said storage tank including a product level sensor, liquid temperature sensor, vapor temperature sensor, and vapor pressure sensor proximate to said storage tank for determining real-time parameters associated with evaporative loss of said hydrocarbon liquid mixture, and wherein said storage tank is available for transferring said hydrocarbon liquid mixture into or out of said storage tank; and a computing device communicably connected to receive data from said plurality of sensors implementing an inventory calculation algorithm stored in an associated non-transitory memory that uses said real-time parameters and at least one known physical property of said hydrocarbon liquid mixture as input parameters, wherein said inventory calculation algorithm automatically calculates in real-time at least one of a calculated measure of static evaporative mass loss and a calculated measure of dynamic evaporative mass loss from said input parameters occurring when said storage tank is breathing through a breather vent and said hydrocarbon liquid mixture is being transferred into and out of said storage tank.

2. The system of claim 1, wherein said inventory calculation algorithm combines said calculated measure of static evaporative mass loss and said calculated measure of dynamic evaporative mass loss with a measure of said hydrocarbon liquid mixture transferred into and out of said storage tank to automatically calculate a stock reconciliation for said storage tank.

3. The system of claim 2, wherein said inventory calculation algorithm generates said calculated measure of static evaporative mass loss and said calculated measure of dynamic evaporative mass loss in terms of averaged loss and real-time loss.

4. The system of claim 1, wherein said plurality of sensors further comprise at least one sensor selected from the group consisting of: a vent valve position sensor, a liquid pressure sensor, a wind speed sensor, a wind direction sensor, a solar insolation sensor, and an air temperature sensor.

5. The system of claim 1, wherein said at least one known physical property of said hydrocarbon liquid mixture comprises at least one characteristic selected from the group consisting of vapor pressure, viscosity, and volatility.

6. The system of claim 1, wherein said inventory calculation algorithm uses at least one of said calculated measure of said static and said dynamic evaporative mass loss to perform a stock reconciliation for said storage tank.

7. A method of monitoring a hydrocarbon liquid mixture stored within a storage tank, comprising:

determining real-time parameters including conditions within said storage tank from sensors installed on said storage tank including a product level sensor, liquid temperature sensor, vapor temperature sensor, and vapor pressure sensor, wherein said storage tank is breathing through a breather vent having an open position and a closed position; and wherein said storage tank is available for transferring said hydrocarbon liquid mixture into or out of said storage tank;

using a computing device implementing an inventory calculation algorithm stored in an associated non-transitory memory that uses said real-time parameters and at least one known physical property of said hydrocarbon liquid mixture as input parameters, automatically calculating in real-time at least one of a calculated measure of static evaporative mass loss and a calculated measure of dynamic evaporative mass loss from said input parameters occurring when said hydrocarbon liquid mixture is being transferred into and out of said storage tank for said hydrocarbon liquid mixture, and using at least one of said calculated measure of said static and said dynamic evaporative mass loss to perform a stock reconciliation for said storage tank.

8. The method of claim 7, wherein said conditions further comprise vent valve position, and liquid pressure.

9. The method of claim 7, further comprising determining at least one environmental condition selected from the group consisting of wind speed, wind direction, solar insolation, and air temperature and using said environmental condition as one of said input parameters.

10. The method of claim 7, wherein said at least one known physical property of said hydrocarbon liquid mixture comprises at least one characteristic selected from the group consisting of vapor pressure, viscosity, and volatility.

11. The method of claim 7, wherein said automatically calculating uses an inventory calculation module realized by said computing device programmed to implement said inventory calculation algorithm.

12. The method of claim 7, wherein said inventory calculation algorithm further comprises combining said calculated measure of static evaporative mass loss and said calculated measure of dynamic evaporative mass loss to automatically calculate a corrected total mass balance for said storage tank.

13. The method of claim 7, further comprising expressing at least one of the group consisting of said calculated measure of static evaporative mass loss and said calculated measure of dynamic evaporative mass loss in terms of an averaged loss and a real-time loss.

* * * * *